United States Patent [19]

Toth et al.

[11] Patent Number: 4,941,527

[45] Date of Patent: Jul. 17, 1990

[54] HEAT PIPE WITH TEMPERATURE GRADIENT

[75] Inventors: Jerome E. Toth, Hatboro; Donald M. Ernst, Leola, both of Pa.

[73] Assignee: Thermacore, Inc., Lancaster, Pa.

[21] Appl. No.: 343,594

[22] Filed: Apr. 26, 1989

[51] Int. Cl.[5] ..... F28D 15/02

[52] U.S. Cl. ..... 165/47; 165/61; 165/104.26; 219/399; 219/401; 219/530

[58] Field of Search ..... 165/104.26, 104.21, 165/47, 61, 48.1; 219/401, 399, 530

[56] References Cited

U.S. PATENT DOCUMENTS

| | | | |
|---|---|---|---|
| 3,543,839 | 12/1970 | Shlosinger | 165/104.26 |
| 3,770,047 | 11/1973 | Kirkpatrick et al. | 165/47 |
| 3,857,990 | 12/1974 | Steininger | 165/104.26 |
| 3,934,643 | 1/1976 | Laing | 165/104.26 |
| 4,026,348 | 5/1977 | Roberts, Jr. | 165/104.26 |
| 4,092,140 | 5/1978 | Cerutti | 165/104.26 |
| 4,099,556 | 7/1978 | Roberts, Jr. | 165/104.26 |
| 4,681,995 | 7/1987 | Ahern | 165/104.26 |

*Primary Examiner*—Albert W. Davis, Jr.
*Attorney, Agent, or Firm*—Martin Fruitman

[57] ABSTRACT

A heat pipe which maintains a controlled temperature gradient over its length. An annular heat pipe is constructed to have a core area which is a working furnace and to have the heat input at one end and a heat sink at the other end of the annular structure. The core is surrounded by an annular vapor space with a restricted cross section. The reduced vapor space creates a temperature gradient over the length of the furnace, and this gradient is variable and controllable depending upon the quantity of heat being transferred from the heat source to the heat sink.

14 Claims, 1 Drawing Sheet

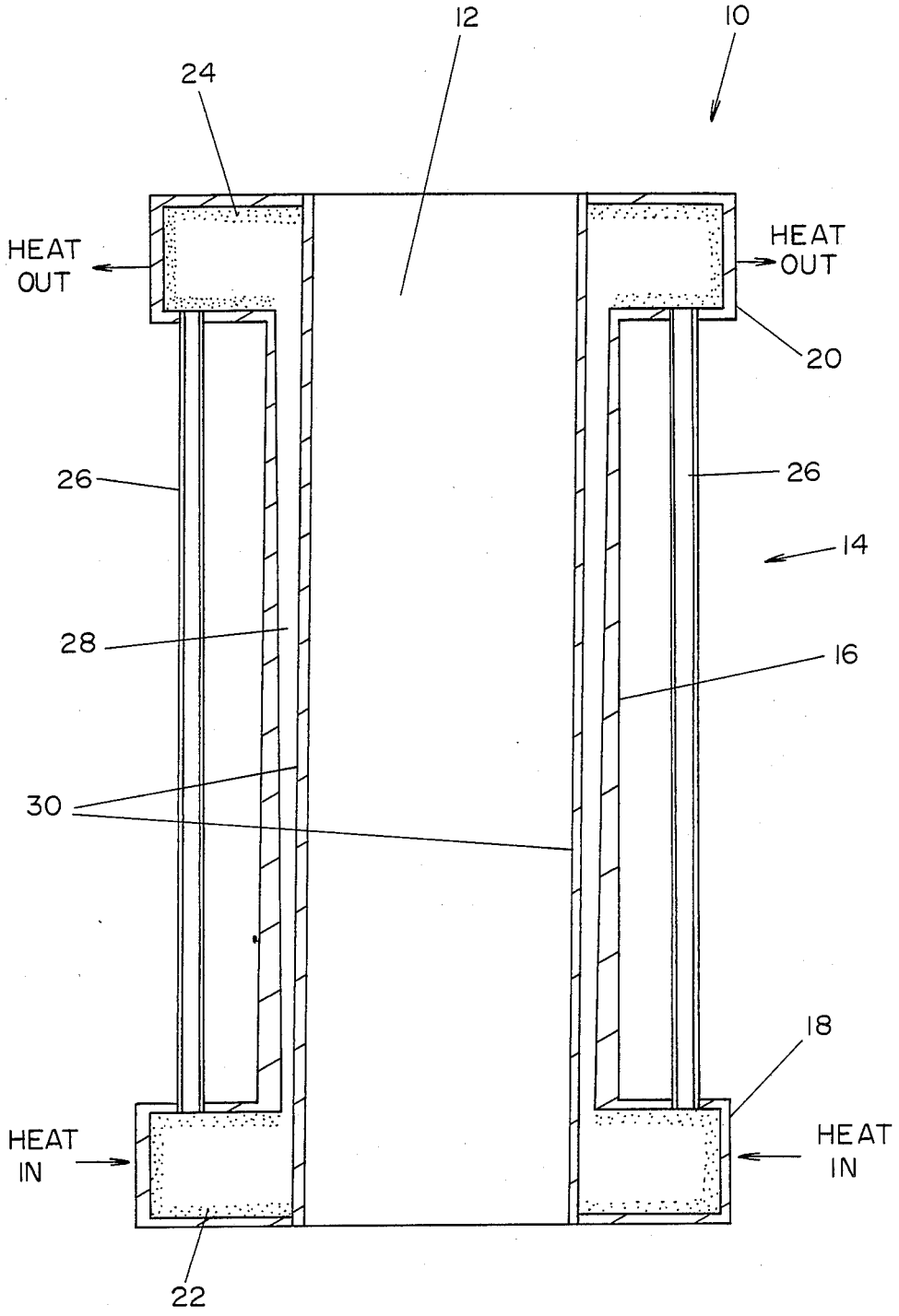
12
10
24
HEAT OUT
HEAT OUT
20
26
26
14
28
16
30
18
HEAT IN
HEAT IN
22

HEAT PIPE WITH TEMPERATURE GRADIENT

SUMMARY OF THE INVENTION

This invention deals generally with heat transfer and more specifically with a heat pipe which has a continuous temperature gradient over its length.

Temperature gradient furnaces are commonly used in the semiconductor industry. The process of semiconductor crystal growth requires a continuous temperature gradient within the furnace heating zone in order to produce high quality semiconductors, and any discontinuity in the heating zone is likely to adversely affect the product.

Nevertheless, no furnace in use creates a truly continuous gradient. The typical furnace depends upon multiple discrete zones to simulate a true gradient. However, regardless of the number or size of the zones and regardless of how they are produced, there are always perceptable discontinuities between zones, and these affect the ultimate quality of the resulting product.

Moreover, the typical multiple zone furnace, some of which use individual heat pipes for each zone, is a severe problem to control. If, for instance, a furnace has ten zones, each zone's control must be integrated with the others so increases or decreases in furnace temperature are properly followed by each zone in the proper proportion.

Ultimately these problems always lead to a greater number of heating zones and a greater complexity of control.

The present invention changes all of that. It offers a furnace constructed of a single heat pipe whose characteristics are designed such that it creates a temperature gradient with no discontinuities whatsoever. Furthermore, the furnace is controllable both for base temperature and temperature gradient over a range of several hundred degrees for both parameters, and the control can be accomplished quite simply.

All this is accomplished by use of a single heat pipe that acts contrary to the very principals for which most heat pipes are used. While a heat pipe is traditionally considered isothermal, that is, with an essentially uniform temperature throughout its entire length, there are actually certain parameters of geometry and power loading that are used to assure that characteristic. They have now become so entrenched in the technology that these parameters are given little consideration.

It is, however, possible to construct a heat pipe with a temperature variation over its length. This can be accomplished by reducing the cross section area of the vapor space for a given power density transferred by the heat pipe. This change in geometry increases the vapor pressure drop along the length of the heat pipe, and since the temperature at any location follows the saturated vapor pressure, the temperature of the heat pipe vapor region varies as does the pressure along the length.

The classic isothermal heat pipe can therefore be transformed into a device with a temperature gradient along its vapor migration path.

Moreover, the nature of the temperature gradient is controllable by the variation in cross sectional area of the vapor region. A reduction in cross sectional area that is equal throughout the length of the path creates an exponential gradient, but virtually any profile of temperature gradient can be created by properly varying the cross sectional area over the path length.

Furthermore, the range of temperature gradient is easily controllable merely by changing the power transferred over the length of the heat pipe, and when the power is varied, all points along the heat pipe change temperature proportionally, and the temperature gradient profile is consistently maintained.

The present invention therefore consists of a heat pipe with a conventional sealed casing which includes conventional vaporizable fluid, but also includes a restricted cross section vapor space that extends along the length of the region for which a temperature gradient is desired.

In the preferred embodiment of the invention, the casing is shaped in an annular configuration which creates a central heated zone within the cylindrical core of the annular structure for use as a furnace. The vapor space of the heat pipe is located immediately adjacent to the inside surface of the annular structure and is itself annular so that it essentially surrounds the heated zone. For convenience of handling the heated items and utilization of gravity, heat is applied to the lower end of the vertically oriented cylindrical heat pipe furnace, and heat is removed by a heat sink at the upper end.

The heated vapor therefore moves upward in the restricted annular vapor passage, is condensed at the upper cooled end of the heat pipe and creates a temperature variation from hotter at the lower end of the heated zone to cooler at the upper end. Condensed liquid is returned to the heated end by capillary action and gravity through separate liquid arteries which are isolated from the vapor passage, so as not to affect the size of the vapor passage.

In the preferred embodiment, the vapor passage is of uniform but restricted cross section, and therefore the temperature gradient along the length of the vapor passage is exponential and continuous. However, the temperature profile can be completely controlled by the cross section of the vapor passage and can, for instance, be made linear or even be made to have discontinuities. Even in such a case, the invention would have the advantage of a single, unified control system.

The control of both the temperature and the temperature gradient of the heat pipe of the present invention is accomplished by simply controlling the heat input and the heat output. With any fixed geometry, an increase in the quantity of heat, the power, transferred through the heat pipe will increase the gradient.

Thus, as the heat input is increased and if the heat output, that is the cooling capability of the heat sink, is sufficient to remove the additional heat, the temperature at the cooler end will remain constant but the temperature gradient will increase and the temperature at the hot end will increase.

Furthermore, if the same heat pipe has its heat sink temperature increased without any increase in heat input, the temperature of the entire heat pipe will increase, but its gradient will remain the same as before.

Thus, complete control can be accomplished merely by adjusting the power input and heat sink temperature, and regardless of which adjustment is made, all points on the casing adjacent to the vapor passage will automatically and precisely follow the adjustment.

The present invention therefore furnishes a truly continuous gradient heat pipe or furnace and permits simple and inexpensive control of both the temperature and the temperature gradient.

BRIEF DESCRIPTION OF THE DRAWING

The FIGURE is a lengthwise cross section view across the axis of the preferred embodiment of the heat pipe furnace of the invention.

DETAILED DESCRIPTION OF THE INVENTION

The FIGURE shows a lengthwise cross section view across the axis of the preferred embodiment of the invention which is in the form of heat pipe furnace 10, in which heat zone 12 is enclosed by heat pipe 14 which creates a continuous temperature gradient.

Heat pipe 14 is constructed of sealed casing 16 at one end of which is evaporator 18 to which heat is applied. The other end of casing 16 is condenser 20 which is subjected to a heat sink (not shown) which removes heat. Evaporator 18 has its inside surface covered with evaporator wick 22 in order to distribute liquid over the inside surfaces of evaporator 18 so that the liquid will be evaporated in conventional fashion for a heat pipe. Similarly, at the condenser end of heat pipe 14, condenser wick 24 is attached to the inside surface of condenser 20 to collect the condensing liquid from the surface of the casing.

Capillary arteries 26 extend from condenser wick 24 to evaporator wick 22 to act as a return path for liquid from condenser 20 to evaporator 18. Arteries 26 are capable of pumping the liquid by capillary action alone, but in the vertical orientation depicted for furnace 10, gravity will aid in the liquid return action. Capillary arteries 28 are preferably located somewhat remote from vapor flow passage 28 so that they will be thermally isolated from the hotter vapor.

Vapor flow passage 28 is configured as an annular chamber concentric to and immediately adjacent to casing surface 30 which encloses heat zone 12.

As described to this point, heat pipe furnace 10 is indistinguishable, except in minor construction details, from previously existing isothermal heat pipe furnaces. Its distinguishing feature, however, is its resistance to vapor flow which is a result of the restricted size of vapor passage 28. The small cross sectional area of vapor passage 28 causes a distinct and measurable vapor pressure drop as the vapor flows from evaporator 18 to condenser 20, and this pressure drop causes a comparable temperature gradient.

The temperature gradient and pressure drop are both continuous and controllable. The basic profile of the temperature gradient, that is the specific variation of each location, is determined by the configuration of vapor flow passage 28. For instance, vapor flow passage 28 could linearly increase in cross sectional area as it approaches condenser 20 or it could vary logarithmically or be constant for its entire length.

However, the actual range of the temperature gradient is determined by the power transferred from the evaporator to the condenser by the flow of the vapor. For instance, in one typical configuration with a constant cross sectional area of 0.92 square centimeters for the vapor flow passage for the entire 45 centimeter active length of the furnace, and with a constant heat sink temperature of 250 degrees centigrade, the temperature gradient is continuous and the total range of the temperature gradient varies with power transfer as follows:

| Power (KW) | Temp. Range (C. degrees) |
|---|---|
| .1 | 0 |
| .4 | 40 |
| 6.3 | 150 |
| 24.1 | 250 |

Therefore, even though the temperature gradient profile is established by the construction of the heat pipe, the actual temperature and range of temperature gradient are easily variable simply by varying the heat input and heat sink temperature.

It is therefore now possible to construct a temperature gradient furnace for such applications as semiconductor crystal growth and have assurances of absolutely no discontinuities in the temperature gradient. Moreover, the single control factor means that the furnace will also have no change of temperature gradient profile due to the interaction of multiple controls.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For instance the capillary wick and arteries 26 could be omitted in a structure where gravity alone is used as the liquid return mechanism.

What is claimed as new and for which Letters Patent of the United States are desired to be secured is:

1. A heat pipe with a temperature gradient over a specific length comprising:

a sealed casing from which non-condensible gases have been evacuated;

a vapor passage extending over a specific length of the sealed casing for which a temperature gradient is required, the vapor passage extending between a heated evaporator region and a cooled condenser region and being restricted in cross sectional area to a size small enough to create a temperature gradient; and a vaporizable fluid within the sealed casing.

2. The heat pipe of claim 1 further including size variations in cross sectional area along the length of the vapor passage to produce a temperature gradient profile required.

3. The heat pipe of claim 1 further including liquid return means extending between the condenser region and the evaporator region.

4. The heat pipe of claim 1 further including at least one liquid return artery extending between the condenser region and the evaporator region.

5. The heat pipe of claim 1 further including at least one liquid return artery extending between the condenser region and the evaporator region, the artery being thermally isolated from the vapor passage.

6. The heat pipe of claim 1 further including a capillary wick means within the evaporator region.

7. The heat pipe of claim 1 further including a capillary wick means within the condenser region.

8. A heat pipe furnace with a temperature gradient over a portion of its length comprising:

a sealed casing wrapped around and enclosing a volume which is a heated zone, non-condensible gases being evacuated from the casing;

a vapor passage located adjacent to the surface of the casing which is adjacent to the heated zone, the vapor passage extending over the length of the heated zone and being of such a restricted cross sectional area to develop a temperature gradient over the length of the vapor passage;

a vaporizable fluid within the sealed casing;

a heat source which applies heat to the sealed casing adjacent to one end of the heated zone; and a heat sink which removes heat from the sealed casing adjacent to the end of the heated zone remote from the heat source.

9. The heat pipe furnace of claim 8 further including size variations in cross sectional area along the length of the vapor passage to produce a temperature gradient profile required.

10. The heat pipe furnace of claim 8 further including liquid return means extending between the condenser region and the evaporator region.

11. The heat pipe furnace of claim 8 further including at least one liquid return artery extending between the condenser region and the evaporator region.

12. The heat pipe furnace of claim 8 further including at least one liquid return artery extending between the condenser region and the evaporator region, the artery being thermally isolated from the vapor passage.

13. The heat pipe furnace of claim 8 further including a capillary wick means within the evaporator region.

14. The heat pipe furnace of claim 8 further including a capillary wick means within the condenser region.

* * * * *